US007975345B2

(12) United States Patent
Weber

(10) Patent No.: US 7,975,345 B2
(45) Date of Patent: Jul. 12, 2011

(54) INTERDENTAL BRUSH

(75) Inventor: Michael Weber, Klagenfurt (AT)

(73) Assignee: Magdalena Weber, Klagenfurt (AT)

( * ) Notice: Subject to any disclaimer, the term of this patent is extended or adjusted under 35 U.S.C. 154(b) by 110 days.

(21) Appl. No.: 11/919,052

(22) PCT Filed: Apr. 28, 2006

(86) PCT No.: PCT/AT2006/000176

§ 371 (c)(1),
(2), (4) Date: Oct. 23, 2007

(87) PCT Pub. No.: WO2006/116784

PCT Pub. Date: Nov. 9, 2006

(65) Prior Publication Data

US 2008/0313834 A1 Dec. 25, 2008

(30) Foreign Application Priority Data

Apr. 29, 2005 (AT) ..... A 741/2005
Apr. 29, 2005 (AT) ..... A 742/2005

(51) Int. Cl.
*A46B 9/04* (2006.01)

(52) U.S. Cl. ..... 15/167.1; 15/176.4; 15/176.5; 15/194

(58) Field of Classification Search ..... 15/167.1, 15/194; 433/141, 102; 132/321, 323
See application file for complete search history.

(56) References Cited

U.S. PATENT DOCUMENTS

| | | | | |
|---|---|---|---|---|
| 4,751,761 | A | 6/1988 | Breitschmid | |
| 5,394,584 | A * | 3/1995 | Breitschmid | 15/167.1 |
| 5,499,420 | A | 3/1996 | Boland | |
| 6,902,399 | B2 * | 6/2005 | Mannschedel | 433/141 |
| 2005/0048439 | A1 * | 3/2005 | Gwen | 433/141 |
| 2005/0118553 | A1 * | 6/2005 | Lagos Galvan | 433/141 |

FOREIGN PATENT DOCUMENTS

| | | |
|---|---|---|
| DE | 100 34 367 C1 | 3/2002 |
| DE | 101 23 814 | 12/2002 |
| EP | 0 311 937 | 2/1989 |
| EP | 0 550 818 | 7/1993 |
| WO | WO 96/06547 | 3/1996 |

OTHER PUBLICATIONS

International Search Report.
European Search Report dated Oct. 22, 2008.

* cited by examiner

*Primary Examiner* — Robert Scruggs
(74) *Attorney, Agent, or Firm* — Collard & Roe, P.C.

(57) ABSTRACT

Interdental brush with an elongate brush body (12) which comprises an elastically compressible coupling member (19) for snapping-in in a receiving opening (18) of a brush handle (13); wherein the coupling member (19) comprises at least two expanding arms (27, 28) which are elastically movable towards each other; the coupling member (19), on its outer side, comprises a snap-in depression (26) in the region of the expanding arms (27, 28) for a positive-locking fit in the receiving opening (18) of the brush handle (13), the depression being delimited by shoulders (29) extending at right angles to the longitudinal axis of the brush body.

11 Claims, 4 Drawing Sheets

FIG. 5
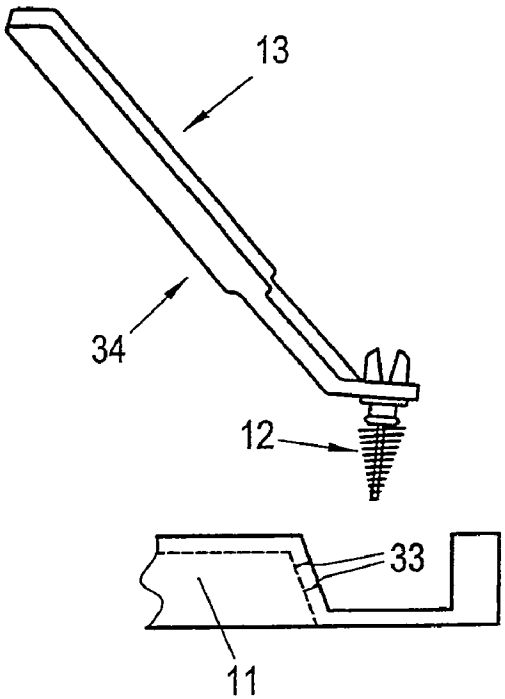
FIG. 5C
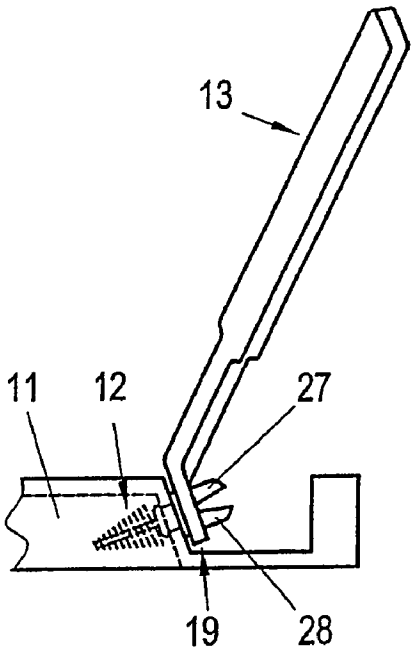
FIG. 5B
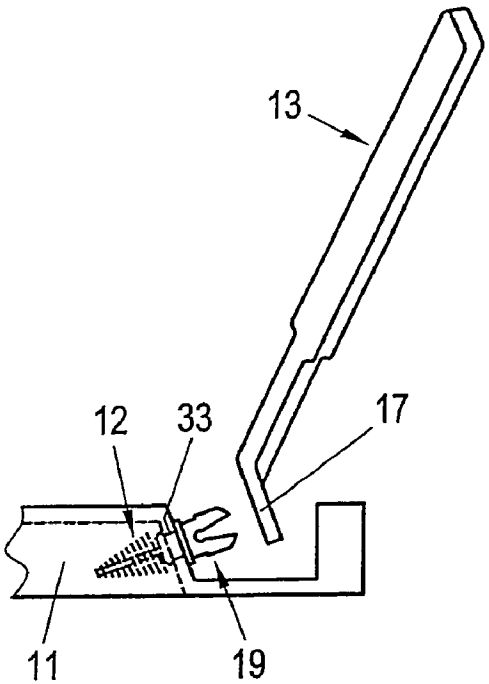
FIG. 5A

INTERDENTAL BRUSH

CROSS REFERENCE TO RELATED APPLICATIONS

Applicant claims priority under 35 U.S.C. §119 of Austrian Application No. A 742/2005 filed Apr. 29, 2005 and Austrian Application No. A 741/2005 filed Apr. 29, 2005. Applicant also claims priority under 35 U.S.C. §365 of PCT/AT2006/000176 filed Apr. 28, 2006. The international application under PCT article 21(2) was not published in English.

The invention relates to an interdental brush with an elongate brush body having an elastically compressible coupling member for snapping-in in a receiving opening of a brush handle, the coupling member having at least two expanding arms which are elastically movable towards each other.

With commercially available interdental brushes, a brush body with a carrying member in the form of a wire element is provided, which member carries bristles and bristle bundles, respectively, as elastically deformable cleaning elements. These brush bodies are attached to a brush handle by means of the carrying wire member, said handle having an opening through which the carrying wire member is put with the rear end, whereafter, by the aid of a flap element provided on the handle, it is bent against the handle and fixed. Due to this specific design with the bristle elements being attached to a carrying wire member, the interdental brushes known are not only relatively complex in production, but also mounting the brush pieces on the brush handle is relatively tedious and insecure.

Furthermore, from DE 101 23 814 A there is known a cleaning instrument for a root canal of a tooth, and also a dental instrument, wherein there a core (called "soul") is provided in the form of a metal rod which is pressed into a hull of a head section, and on which a shaft-shaped bristle-carrying member with bristles integrally formed therewith is provided. This actual body of the cleaning elements is made of plastics by injection-moulding. However, this does not give any details on the connection of said cleaning instrument with a handle.

Moreover, an interdental brush is known from EP 550 818 A which is designed in a per se conventional manner with a wire core and bristles attached thereto, and which comprises a rear coupling member for snap-in engagement with a brush handle. There, the coupling member preferably has a spherical undercut snap-in depression, into which a spherical body provided on the brush handle can be plugged-in by snap-in engagement. On the other hand, in one embodiment the coupling member of the interdental brush comprises a split spherical member which is put through an opening in the brush handle, wherein the spherical segments present spaced apart from each other in a snap-in position free from traction can be moved towards each other for putting them through the receiving opening in the brush handle. Thus, in their fixed position, said spherical segments contact generally inclined surfaces on the rim of the receiving opening of the brush handle; thereby, if there is a stronger traction between the brush body and the handle, the brush handle can be unintentionally pulled out from the receiving opening of the brush handle and may, e.g. remain stuck in an inter-tooth space. In order to overcome this disadvantage, the other embodiments of this document provide for a locking by turning the brush member relative to the brush handle by 90° C. Such a locking by turning is, however, not possible with the mentioned embodiment comprising the spherical coupling member so that the disadvantage of unintentional, accidental detachment of the interdental brush from the brush handle is not avoided.

It is now an object of the invention to provide an interdental brush of the initially defined kind, which is simple in production and suitable for large-scale production, and with which an easy and secure mounting and fixing of the respective brush body on the brush handle is achieved.

The inventive interdental brush of the above-defined kind is characterised in that the coupling member, on its outer side, in the region of the expanding arms has a snap-in depression which is delimited by shoulders extending at right angles to the longitudinal axis of the brush body for a positive-locking fit in the receiving opening of the brush handle.

With the inventive embodiment of the interdental brush the coupling member is, thus, fixed in the receiving opening of the brush handle in a positive-locking manner by elastic deformation. Thus, it is achieved that the brush body can only be detached from the brush handle by eliminating the positive locking, i.e. by consciously compressing the two expanding arms; thus, the inventive embodiment prevents the brush body from accidentally, unintentionally detaching when a force threshold value (traction force between brush body and brush handle) is reached, as is the case in the prior art, where, thus, the frictional locking between the coupling member and the brush handle is removed by said minimum traction force.

Basically, the expanding arms may be formed by tubular parts, wherein a circular cylindrical external form is favourable. In order to facilitate sliding-on of the brush handle with its receiving opening onto the expanding arms, the latter are, however, at least on their ends rounded or chamfered. Preferably, the expanding arms have a circular-arc-shaped surface on their external side, which arms cooperate with a receiving opening in the brush handle, said opening being circular, seen in top view. In this context, the connecting member of the brush handle is preferably simply of a flat design. This above-mentioned circular cross-section form offers the advantage that, when coupling the brush body with the brush handle, no attention has to be paid to a specific orientation of the two elements to be coupled together.

In order to be able to detachably hold the brush element(s) temporarily in a holding member, as in a multiple magazine, for later use, it is advantageous if the coupling member comprises a snap-in groove for snap-in engagement with an opening rim of a holding member.

For producing the interdental brush, it has been proven to be particularly favourable when the brush element is an injection-mouled element, preferably made of a thermoplast, in particular of a thermoplastic elastomer, e.g. of polypropylene, polyethylene, polyurethane, polyetherester co-polymer or silicone rubber, or of polyamide.

The cleaning elements of the brush element can be of the most different designs, wherein the only significant point is that they are sufficiently elastically deformable. For this purpose, a thin-walled design is to be provided which is chosen in correspondence with the (plastics) material used, the cleaning elements could, e.g., join the carrying member in the form of platelets, strips or annular plates. To allow for a simple production, on the one hand, and for a good cleaning effect, on the other hand, the cleaning elements may be formed by a screw-shaped spiral having several turns. In this respect, it is also favourable for a particularly simple production when the spiral is integrally designed from plastics with a central carrying member.

It is advantageous for introducing the brush body into root canals of a tooth and for a good cleaning effect if the spiral has dimensions that increase from one end of the carrying member, that is, the front end, to the other end, that is, the rear end. It is particularly favourable for an efficient cleaning of the interdental spaces if the spiral substantially defines a frustoconical shape with its outer rim. It is also advantageous for a simple use and a secure hold of the interdental brush proper in the receiving opening in the brush handle when the carrying member integrally joins the coupling member. Here, the brush body is a single-part compact component which cannot be detached when being used and which is simply coupled with the brush handle in a positive-locking manner in the described way.

In order to allow for a simple removal of the respective brush element from a magazine by clipping on the brush handle and, furthermore, to achieve a user-friendly design of the interdental brush as a whole, it is, moreover, advantageous if the brush handle comprises an angled connecting member for connection with the coupling member.

In the following, the invention will be explained in more detail by way of the particularly preferred exemplary embodiments illustrated in the figure, yet without being limited thereto. Therein:

FIGS. 5A to 5C show different stages during take-up of such an interdental brush body with the aid of a brush handle, and during coupling of these two components.

Figure 1:
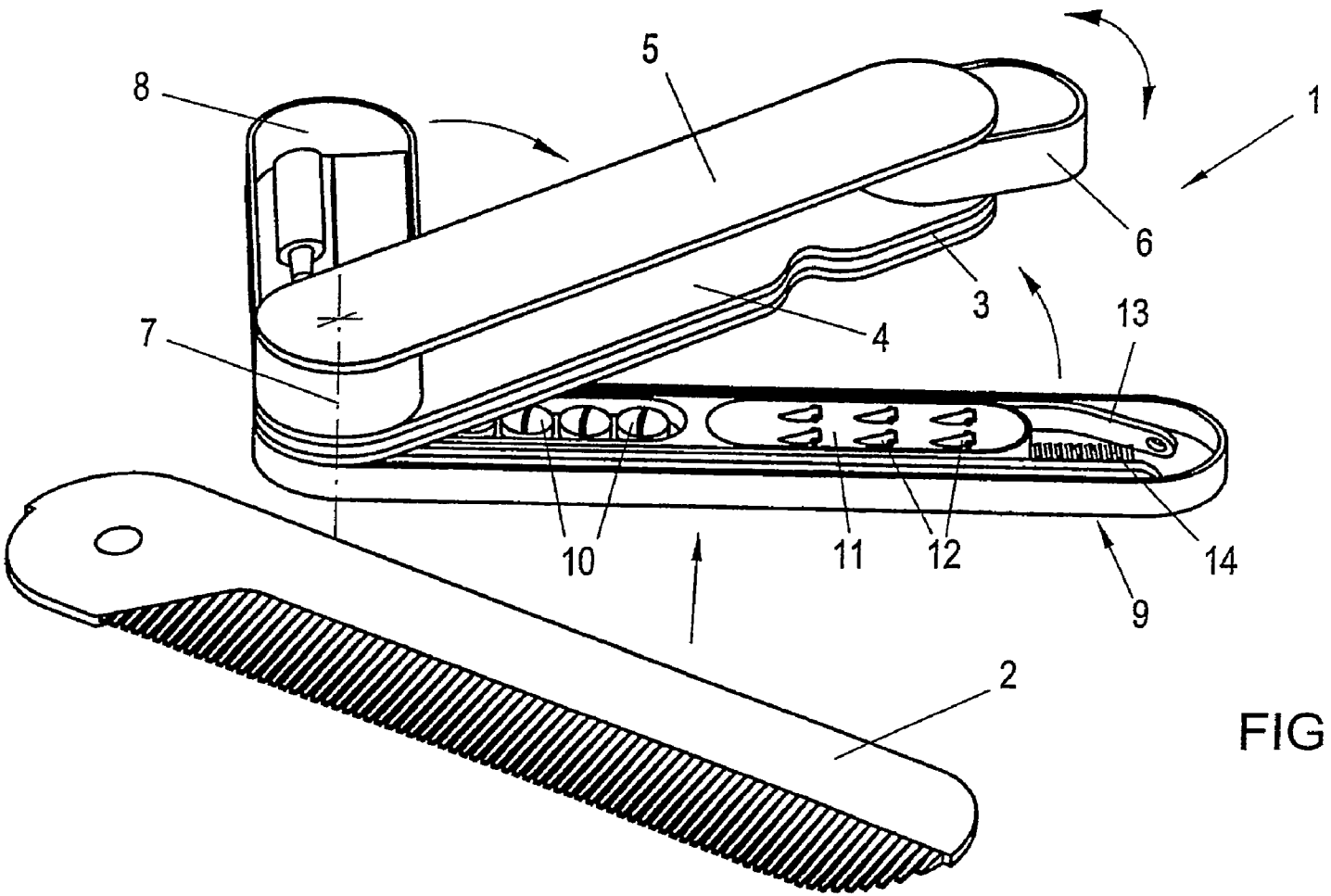
FIG. 1 shows a perspective view of a case, e.g. a travel case, for different toilet products, wherein, i.a., an inventive interdental brush is stored in this case.

In FIG. 1 a flap case 1 designed with several receiving levels, such as a travel case or a case of that type hotels provide their hotel guests with, is illustrated as particularly advantageous possibility for accommodating and offering interdental brushes according to the invention; in this respect, furthermore, a comb 2 is shown in an exploded view, which comb can be inserted into a slot 3 of a double-intermediate wall 4 of the flap case 1. On the one hand, this double wall further carries, together with an upper top wall 5, a small container 6 for dental floss, said dental-floss insert being exchangeable, and, on the other hand, carries a container 8 for toothpaste, mouthwash and similar products in the region of a not further illustrated, only schematically indicated swiveling axis 7 of the case, said container being retractably rotatable to a position between the upper top wall 5 and the double wall 4.

In a bottom member 9, in addition to possible dying-tablets 10 for plaque control, a magazine 11 for several interdental brush bodies 12 is arranged. Furthermore, a brush handle 13 for said brush body 12 is provided in the bottom element 9, wherein coupling of said brush handle 13 with the brush body 12 will in the following be explained in more detail by way of FIGS. 5A to 5C. Moreover, a conventional tooth brush 14 can be stored in the container element 9.

Figure 2:
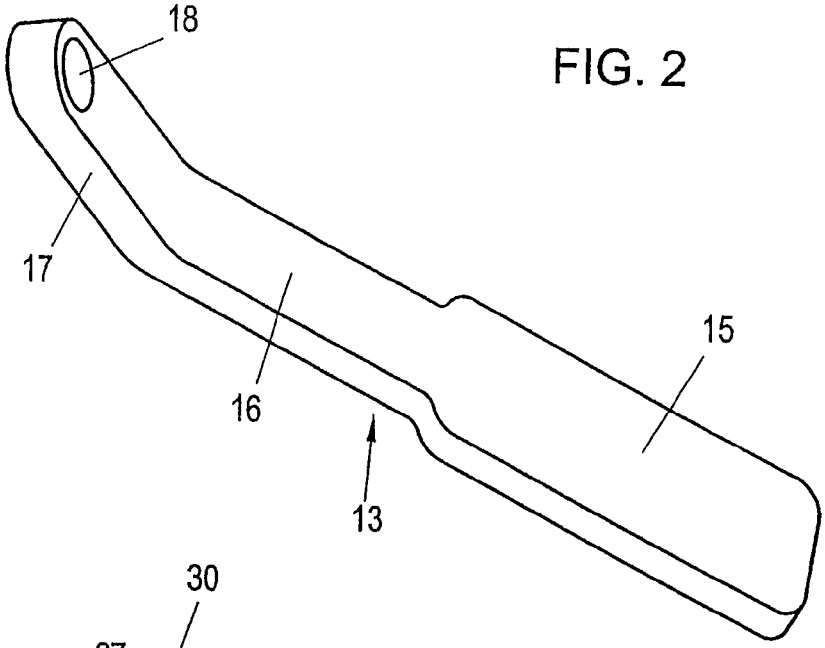
FIG. 2 shows a perspective view of a brush handle for an interdental brush according to the invention.
Figure 4:
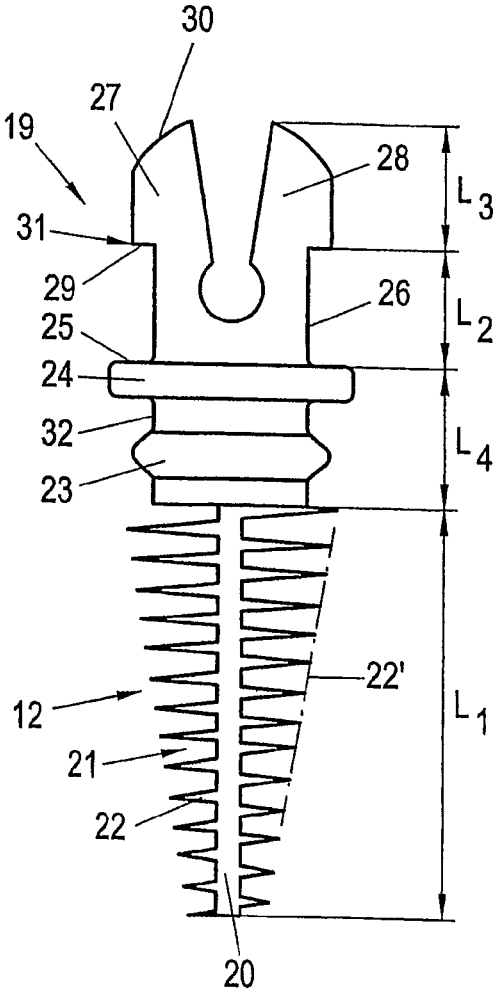
FIG. 4 shows a schematic view of a brush body.

In FIG. 2 one embodiment of the brush handle 13 with which the brush bodies 12 can be coupled is shown in more detail. A broadened rear brush grip 15 is illustrated which is connected with to an angled front connecting member 17 via a narrower intermediate member 16, which member 17, in its cross-section, comprises an, e.g., circular receiving opening 18 provided for receiving a coupling member 19 (s. FIG. 4) of the respective brush body 12.

Figure 3:
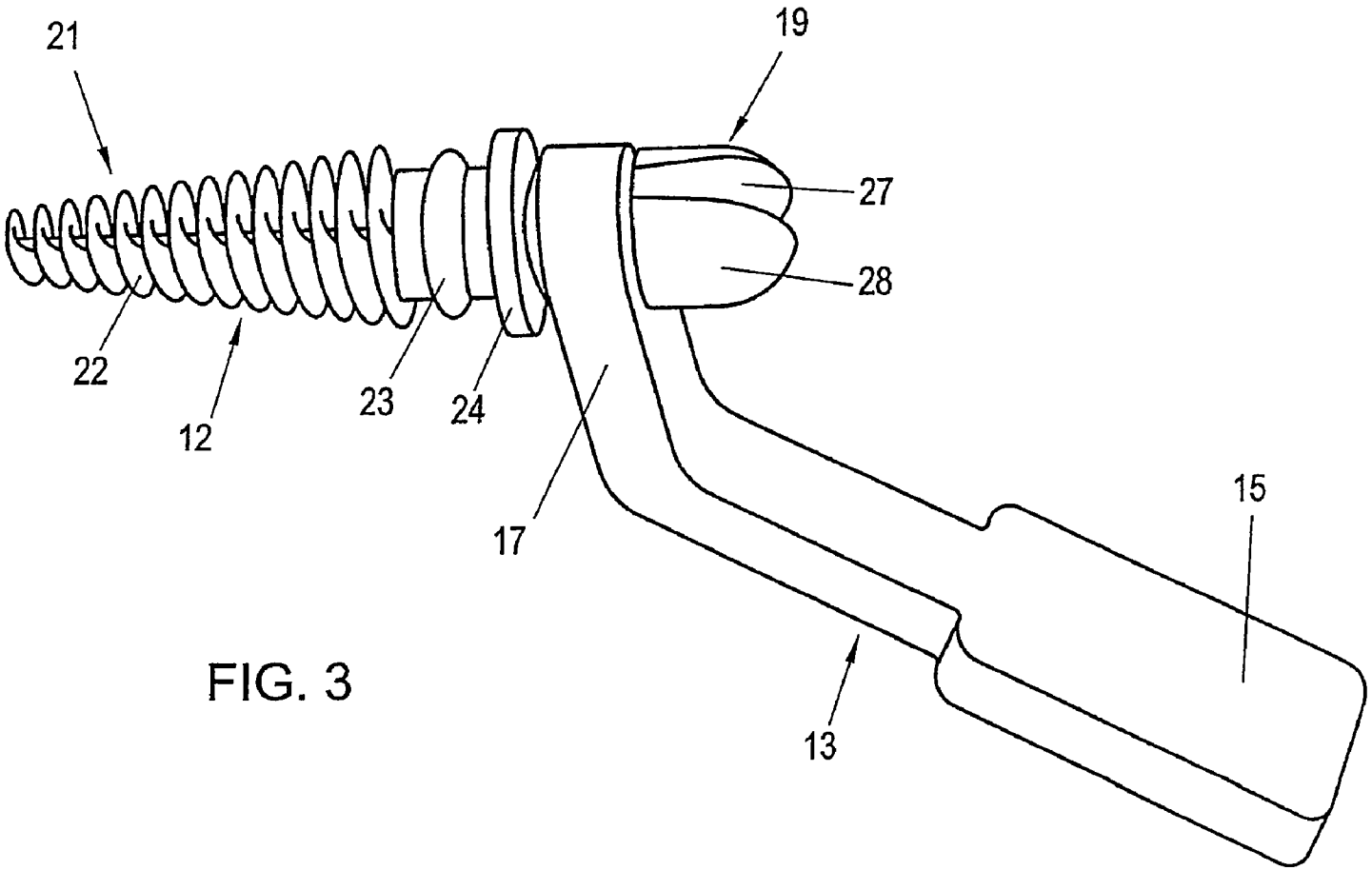
FIG. 3 shows a perspective view of a brush handle plus interdental brush body attached thereto.

In FIG. 3 such a brush handle 13 connected to a brush body 12 is shown, wherein the coupling member 19 of the brush body 12 is inserted into the receiving opening 18 (s. FIG. 2) of the connecting member 17 by snapping-in or engaging and is fixed.

According to FIGS. 3 and 4, the present brush body 12 integrally designed with the coupling member 19 comprises an elongate thin rod-shaped carrying member 20 which carries elastically deformable cleaning elements 21. These cleaning elements 21 are, as can be further seen from FIGS. 3 and 4, formed by individual turns of a screw-shaped spiral 22 having several turns, wherein said spiral 22 is integrally designed with the carrying member 20. The spiral 22 follows with its outer helcoid-shaped rim a frustoconical surface 22'. The length of the actual brush section is, e.g., 12 mm, said length being denoted by L1 in FIG. 4, said brush section being formed by the carrying member 12 plus spiral 22. The rear coupling member 19 may have an axial total length of 10 mm, wherein the coupling member 19 integrally continues into the carrying member 20 via a shoulder and may generally have a circular cross-section with a diameter of from 3 to 4 mm. Two front-side annular projections 23, 24 are provided, e.g. for delimitation during cleaning of interdental spaces and for retaining in a magazine 11 as well as for forming a shoulder 25 as delimitation for a snap-in depression 26. The rear region of the coupling member 19 is divided so that two expanding arms 27, 28 are obtained which are "expanded" in their normal position shown in FIG. 4 and which, thus, form shoulders 29 for delimiting the respective—in the cross-section circular-arc-shaped—snap-in depression 26 on their other side. The expanding arms 27, 28 are chamfered or rounded on that rear end which faces away from the brush section, as illustrated in FIG. 4 at 30, in order to facilitate introduction into the receiving opening 18 of the brush handle 13 (s. FIG. 2). Engaging surfaces 31 which, in the cross-section, are circular-arc-shaped are defined by the shoulders 31, which surfaces cooperate with the rim of the receiving opening 18 of the brush handle 13. In corresponding manner, the shoulder 25 defines an annular engaging surface for cooperation with the connecting member 17 of the brush head 13, cf. also FIG. 3. At least the two shoulders 29, preferably also the shoulder 25, extend at right angles to the longitudinal axis of the brush body 12 in order to ensure an engagement at right angles to the longitudinal axis, thus a positive-locking, when, according to FIG. 3, the brush body 12 is inserted into the receiving opening 18.

When introducing the coupling member 19 with the expanding arms 27, 28 into the receiving opening 18 of the brush handle 13, the towards each other in the manner of a pivoting movement, and after the expanding arms 27, 28 have passed the receiving opening 18 with their broadened rear area, the expanding arms 27, 28 will resiliently move back in a radially outward direction, wherein the snap-in depression 26 which is delimited by the shoulders 25 and 29, respectively, will receive the rim of the receiving opening 18 of the brush handle 13 in a snap-in or an engaging step. Thereafter, the brush body 12 cannot be detached from the handle 13 by simple pulling-out, rather, the expanding arms 27, 28 will have to be manually compressed for this purpose, i.e. they will have to be pivoted in direction towards each other to eliminate the positive locking in the region of the shoulders 29.

Coupling by snap-in engagement of the brush body 12 and its coupling member 19 with the brush handle 13 is schematically shown in FIGS. 5A, 5B and 5C. As already set forth above with respect to FIG. 1, several brush bodies 12 can be retained in a magazine 11 provided as holding member, e.g. in an inclined position as shown in FIGS. 5A and 5B, in a receiving seal having an opening rim 33 (s. FIG. 5C) which fits in a snap-in groove 32 (s. FIG. 4) between the projections 23 and 24, and the brush handle 13 may be brought closer to the coupling member 19 of the respective brush body 12 with its angled connecting member 17 (s. FIG. 5A), and may then be slid on the coupling member 19 with its receiving opening 18 via the expanding arms 18, 28 by compressing the latter (s. FIG. 5B). Thereafter, the brush body 12 is pulled out from its receiving member in a magazine 11 by the aid of the brush handle 13, optionally under elastic deformation of the opening rim 33 which engages in the snap-in groove 32 between the projections 23, 24, and the thus obtained complete interdental-brush arrangement 34 can then be used (s. FIG. 5C).

In a specific exemplary embodiment the axial length L2 of the snap-in groove 26 was 3 mm, the expanding section of the expanding arms 27, 28 following therebehind had also an axial length L3 of 3 mm and the stop and fixing section of the coupling member 19 in front thereof had a total length L4 of 4 mm, the projections 23, 24 having an axial length of 1 mm each and the adjoining sections, such as the snap-in groove 32, also having a length of 1 mm each.

The brush body 12 shown may advantageously be produced as injection-moulded part from a suitable plastics, e.g. in particular from a thermoplast, in particular from a thermoplastic elastomer, as may the brush handle 13. Suitable materials which lead to the required elastic deformability of the spiral 22 (with correspondingly thin wall thickness of the same), on the one hand, and to the required strength in the thicker coupling member 19, on the other hand, are, e.g. polypropylene, polyethylene, polyurethane, polyetherester co-polymer, silicone rubber and also nylon (polyamide 6.6) and similar materials. It is also conceivable to produce the carrying member 20 with an internal core which is then extrusion-coated, forming the spiral 22; the core may, e.g. also consist of a GRP (glass-fibre reinforced plastics).

The invention claimed is:

1. Interdental brush with an elongate brush body which comprises a brush member connected to a coupling member adapted for snapping-in in a receiving opening of a brush handle in an operational state, said brush handle having a front side and a rear side, wherein the coupling member has first and second expanding arms which are elastically movable towards each other, and which, in the snapped-in position, have rear ends arranged for freely projecting from the rear side of the brush handle, wherein the coupling member, on its lateral outer side, comprises a snap-in depression in the region of the expanding arms, said depression being delimited by first and second right-angled shoulders extending at right angles to the longitudinal axis of the brush body, said depression having a first depression end formed by the first shoulder, a second depression end formed by the second shoulder, and a depression base laterally inward of said shoulders and extending parallel to the longitudinal axis of the brush body from the first depression end to the second depression end, wherein each expanding arm has a respective outer side comprising a circular-arc-shaped first surface at the rear end of the expanding arm and a second surface extending from the first surface to the first right-angled shoulder parallel to the longitudinal axis of the brush body, wherein the coupling member in the snapped-in operational state is held in the receiving opening of the brush handle in a positive locking fit, wherein the coupling member has a strength such that the coupling member can be detached from the receiving opening only by manually deflecting the at least two expanding arms freely extending from the rear side of the brush handle towards each other, to eliminate the positive locking fit of the coupling member in the receiving opening, and wherein the coupling member comprises a further snap-in groove delimited by first and second axially spaced and radially extending projections, for snap-in engagement with an opening rim of a holding member, the first projection being next to the brush element and comprising first and second sloped surfaces engaging the opening rim when moving the interdental brush with respect to the opening, and wherein the second projection defines, with its radial surface opposed to the brush member, said second right-angled shoulder.

2. Interdental brush according to claim 1, wherein the brush body is an injection-moulded part.

3. Interdental brush according to claim 2, wherein the injection molded part is made of silicone rubber or a thermoplastic elastomer selected from the group consisting of polypropylene, polyethylene, polyurethane, polyetherester co-polymer or polyamide.

4. Interdental brush according to claim 2, wherein the injection-moulded part is made of a thermoplast.

5. Interdental brush according to claim 1, wherein the brush body comprises a central carrying member and a screw-shaped continuous spiral, said carrying member having a front end and a rear end, said screw-shaped continuous spiral having several turns acting as cleaning elements extending continuously from the front end of the carrying member to the rear end of the carrying member, each turn on a first lateral side of the brush body parallel to the longitudinal axis of the brush body being disposed between adjacent turns on a second lateral side of the brush body opposite to the first lateral side.

6. Interdental brush according to claim 5, wherein the spiral is integrally designed from plastics with the central carrying member.

7. Interdental brush according to claim 5, wherein the spiral has increasing dimensions from the front end to the rear end.

8. Interdental brush according to claim 7, wherein the spiral substantially defines a frustoconical shape with its outer rim.

9. Interdental brush according to claim 5, wherein the carrying member integrally joins the coupling member.

10. Interdental brush according to claim 1, including a brush handle which comprises a plane connecting member with a circular receiving opening.

11. Interdental brush according to claim 10, wherein the connecting member of the brush handle is angled.

* * * * *